United States Patent [19]

Wakui et al.

[11] Patent Number: 4,978,583

[45] Date of Patent: Dec. 18, 1990

[54] PATTERNED METAL PLATE AND PRODUCTION THEREOF

[75] Inventors: Tsuneyoshi Wakui; Takeo Ohnishi; Yuji Shimoyama; Hideo Kuguminato; Fumio Kosumi; Tadaaki Yasumi; Hironobu Ohno; Toshio Akizuki; Fumiya Yanagishima, all of Chiba, Japan

[73] Assignee: Kawasaki Steel Corporation, Hyogo, Japan

[21] Appl. No.: 136,729

[22] Filed: Dec. 22, 1987

[30] Foreign Application Priority Data

Dec. 25, 1986 [JP] Japan ..... 61-310601
Jul. 27, 1987 [JP] Japan ..... 62-187346

[51] Int. Cl.[5] ..... B21D 53/00

[52] U.S. Cl. ..... 428/600; 428/687; 428/923; 72/199; 29/121.1; 219/121.68

[58] Field of Search ..... 428/679, 684, 687, 600, 428/601, 923, 925; 29/121.1, 121.8, 121.4, 121.5, 121.6, 121.7, 121.2; 72/199; 219/121.67, 121.68, 121.69

[56] References Cited

U.S. PATENT DOCUMENTS

| | | | |
|---|---|---|---|
| 2,991,544 | 7/1961 | Gotsch et al. | 428/687 |
| 3,619,881 | 4/1971 | Bills | 428/687 |
| 4,071,657 | 1/1978 | Rault | 428/646 |
| 4,655,136 | 4/1987 | Reiss et al. | 428/687 |
| 4,679,288 | 7/1987 | Monfort et al. | 29/132 |
| 4,775,599 | 10/1988 | Matsuoka et al. | 428/687 |
| 4,783,378 | 11/1988 | Wakui et al. | 428/687 |
| 4,795,681 | 1/1989 | Furukawa et al. | 428/687 |
| 4,797,327 | 1/1989 | Honda et al. | 428/687 |
| 4,798,772 | 1/1989 | Furukawa | 428/687 |

FOREIGN PATENT DOCUMENTS

| | | | |
|---|---|---|---|
| 157754 | 10/1985 | European Pat. Off. | 29/121.8 |
| 8330 | 4/1979 | Japan | 428/687 |
| 1045641 | 10/1966 | United Kingdom | 428/687 |
| 2040824A | 9/1980 | United Kingdom | 219/121 LM |
| 2069906A | 9/1981 | United Kingdom | 219/121 LM |

OTHER PUBLICATIONS

J. Crahay et al., "Gravure dela Rugositédes Cylindres de Luminoir par Impulsions Laser", Revue de Métallurgie-CIT, May 1983, pp. 393–401.

"Texturing Ups Strength to Lower Metal Weight", Iron Age, Aug. 23, 1976, pp. 30–32.

Ketcham, H., "Designing with Textured Metals", Product Engineering, Mar., 1949, pp. 102–103.

Allen, A. H., "Texturized Metals Find Wide Application", Steel, May 24, 1948, pp. 94–97, 119–120.

*Primary Examiner*—John J. Zimmerman

*Attorney, Agent, or Firm*—Austin R. Miller

[57] ABSTRACT

An uneven patterned metal strip or plate is formed with an uneven pattern as a surface decorative pattern. The pattern is constituted of one or more pattern unit containing a plurality of uneven dot. Each of the uneven dots has a size D. The uneven dots are arranged in a predetermined density to have given ratio $\eta$ of occupying area versus plane area in said pattern unit. The size D and area ratio $\eta$ being in a range of:

$10 \leqq D \leqq 300$ (μm)
$30 \leqq \eta \leqq 100$ (%)

and the size of said pattern unit has minimum length of 1 mm.

34 Claims, 12 Drawing Sheets

FIG. 12
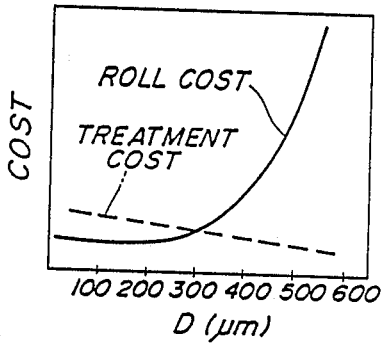
FIG. 13 (a)
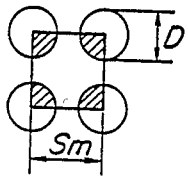
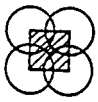
FIG. 13 (b)
FIG. 14
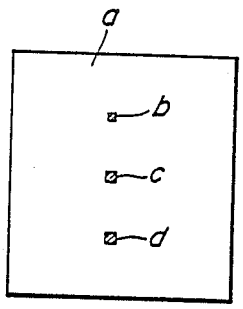

FIG.25(a)
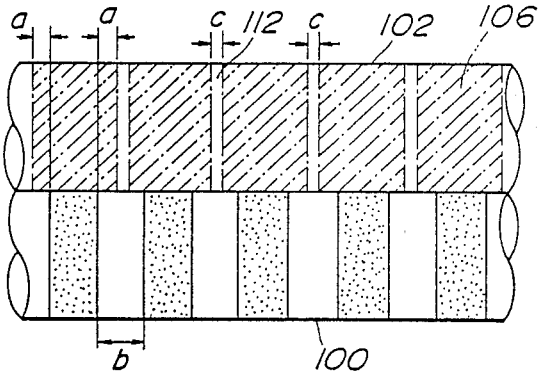
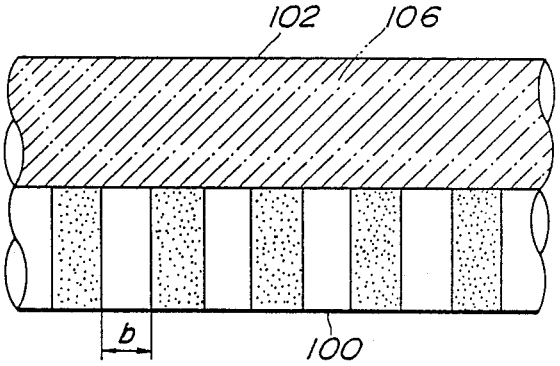
FIG.25(b)

PATTERNED METAL PLATE AND PRODUCTION THEREOF

BACKGROUND OF THE INVENTION

1. Field of the Invention

The present invention relates generally to a metal plate, such as steel plate, with a surface decorative pattern. More specifically, the invention relates to a patterned metal plate having a dulled decorative pattern on its surface. The invention also relates to a method for producing the patterned metal plate. Further particularly, the invention relates to a method for producing a decoratively patterned, corrosion resistant and weather resistant metal strip.

2. Description of the Background Art

Because of their cool appearance, plated metal plates, such as tin plate, chromium plating galvanized plates and so forth, are rarely used in a form exposing the bare surface thereof. In order to make the metal plates useful, it is usual to print or paint desired pattern on a surface of the metal plate. This requires a printing or painting process to increase the production cost for such plate.

In another approach for giving the metal plate a higher commercial value, metal plates with an emboss-treated surface have been proposed. Uneven emboss pattern is formed on the metal plate surface for providing a cube effect, with natural feeling and shade for giving a better quality feeling. Nowadays, three types of emboss patterned metal plates have been developed and proposed.

For example, the Japanese Patent First (unexamined) Publication (Tokkai) Showa No. 51-7356 and the Japanese Patent First (unexamined) Publication (Tokkai) Showa No. 53-88080 discloses a metal plates, on which surfaces are treated by metallic plating. On the metallic plating layer, an emboss patterned transparent layer is formed. In the alternative, the metallic plated surface is coated by a transparent layer. Emboss treatment is performed for the transparent layer. Such metal plates are provided corrosion resistance and rust-proofing ability by the transparent layer, and have a bright or glossy appearance.

Though such process may provide satisfactorily high quality of metal plate with decorative uneven pattern, the production process requires various extra steps. This binders the process to be applied for mass-production and causes high production cost.

On the other hand, the Japanese Patent First (unexamined) Publication (Tokkai) Showa 53-55454 proposes to provide an emboss pattern on the surface of the metal plate, on which surface metallic plating or resin coating layer is formed by rolling utilizing a roll on which a surface emboss treatment in a desired pattern is formed. The metal plate is thus formed with an uneven emboss pattern corresponding to the emboss pattern of the peripheral surface of the roll. The metal plate thus produced may have a cube effect. Tokkai Showa No. 53-55454 further proposed to provide a top-to-bottom height difference in the projecting portion and a depressed portion within a range of 10 $\mu$m to 400 $\mu$m and a surface roughness greater than or equal to 5S. By controlling such controlled magnitude of roughness on the surface, the metal plate surface may be provided definite pattern with contrast in brightness.

In this process, the plated layer and surface coating layer as subjected to a rolling process tends to expand together with the metal plate to cause cracking and pin holes to degrade its corrosion resistance and rust-proofing ability. Furthermore, when the metal plate is thin, the embossed uneven pattern may be formed, forming unevenness on the opposite surface. This narrows the usage.

The Japanese Patent First (unexamined) Publication (Tokkai) Showa No. 52-118819 discloses a metal plate, bare surface of which is emboss-treated to form an uneven pattern. On the emboss-treated surface, a surface protective layer is formed.

This method is generally applicable for forming a random uneven pattern and is difficult to form the desired uneven pattern. In the alternative, in order to form the desired uneven pattern, it is essential to have a roll having a surface formed with a desired uneven pattern on the periphery. Therefore, for forming a desired or regular pattern of unevenness has to be formed on the peripheral surface of the roll.

Emboss-treatment on the metal plate is generally performed by means of a dull roll having a surface formed with a desired uneven pattern to be transferred on the metal plate surface. For forming the desired pattern of unevenness on the peripheral surface of the roll, a photoetching process as disclosed in the Japanese Patent First (unexamined) Publication (Tokkai) Showa No. 50-39235 for example, and mechanical treatment as disclosed in the Japanese Patent First (unexamined) Publication (Tokkai) Showa 50-161451, the Japanese Patent First (unexamined) Publication (Tokkai) 54-130460 for example are proposed. The photoetching process is complicated and thus causes substantial cost in production of the roll. Mechanical treatment is less expensive in comparison with photoetching. However, mechanical treatment can form only a random pattern of unevenness on the peripheral surface of the roll. Furthermore, since a sufficient magnitude of unevenness cannot be formed by the process of photoetching, light shot dull treatment is performed on the surface of the metal plate. Thereafter, dulling treatment for forming projecting unevenness or depressing unevenness which has greater area as a result of shot dull treatment for providing greater contrast. In the alternative, mat finishing is performed for the depressed portion of the metal plate.

On the other hand, the Japanese Patent First (unexamined) Publication (Tokkai) Showa No. 61-14901 discloses formation of the dulled roll by shot blasting process with masking of the desired uneven pattern. This masking process tends to require extra step in treatment.

SUMMARY OF THE INVENTION

Therefore, it is an object of the present invention to provide a patterned metal plate which is less expensive to produce and can exhibit good decorative appearance with high corrosion resistance and weather resistance.

Another object of the invention is to provide a method for producing the patterned metal plate of the invention.

According to one aspect of the invention, an uneven patterned metal strip or plate, according to the present invention, is formed with an uneven pattern as a surface decorative pattern. The pattern is constituted of one or more pattern units containing a plurality of uneven dots. Each of the uneven dots has a size D. The uneven dots are arranged in a predetermined density to have a given ratio $\eta$ of occupying area versus plane area in said pattern unit. The size D and area ratio $\eta$ being in a range as hereinafter defined:

According to the present invention, an uneven patterned metal plate having a surface, on which uneven pattern is formed by at least one pattern unit constituted by a plurality of uneven dots, each of which has a size D. the uneven dots being arranged in a predetermined density to have given ratio $\eta$ of occupying area versus plane area in the pattern unit, the size D and area ratio $\eta$ being in a range of:

$$10 \leqq D \leqq 300\ (\mu m)$$

$$30 \leqq \pi \leqq 100\ (\%)$$

and the size of the pattern unit has minimum length of 1 mm.

According to another aspect of the invention, a process for forming an uneven pattern on a metal strip comprising the steps of:

providing a work roll for temper rolling having a surface roughness Ra smaller than or equal to 0.40 $\mu$m;

performing a dulling operation for forming a desired uneven pattern to be formed on the metal strip, which uneven pattern is formed by at least one pattern unit constituted by a plurality of uneven dots, each of which has a size D, the uneven dots being arranged in a predetermined density to have given ratio $\eta$ of occupying area versus plane area in the pattern unit, the size D and area ratio $\eta$ being in a range of:

$$10 \leqq D \leqq 300\ (\mu m)$$

$$30 \leqq \eta \leqq 100\ (\%)$$

and the size of the pattern unit has minimum length of 1 mm;

setting the dulled work roll in a temper rolling mill and performing temper rolling for temper rolling and transferring the uneven pattern onto the surface of the metal strip.

According to a further aspect of the invention, an apparatus for performing temper rolling for a metal strip to form a desired uneven pattern on the surface of the metal strip, comprises a work roll for temper rolling formed with a desired uneven pattern corresponding to the uneven pattern to be formed on the metal strip, which uneven pattern is formed by at least one pattern unit constituted by a plurality of uneven dots, each of which has a size D. the uneven dots being arranged in a predetermined density to have given ratio of occupying area versus plane area in the pattern unit, the size D and area ratio $\eta$ being in a range of:

$$10 \leqq D \leqq 300\ (\mu m)$$

$$30 \leqq \eta \leqq 100\ (\%)$$

and the size of the pattern unit has minimum length of 1 mm, and a temper rolling mill, in which the work roll is to be set for performing temper rolling for transferring the uneven pattern onto the surface of the metal strip.

The work roll is formed with the uneven dots constituting the uneven pattern by means of high density energy beam, such as a laser beam.

The surface roughness Ra of the plane area is smaller than or equal to 0.40 $\mu$m. The uneven dot is formed into an essentially circular configuration having the predetermined diameter of D.

The pattern unit has a width or axial length greater than or equal to 1 mm. The pattern unit is in a form of a line having a width greater than or equal to 1 mm. The pattern unit in a form of line is distanced from the next pattern unit in a distance greater than or equal to 1 mm.

The apparatus may further comprise a plating means for forming a plating layer on the surface. The plating means forms the plating layer having thicker thickness at the projecting peak portion of each uneven dot than that at the depressed portion of each even dot.

The temper rolling mill includes axially driving means for driving one of the work roll and a roll with plane surface and contacting with the work roll to cause relative shift in axial direction. The axially driving means drives the one of work roll and the plane surface roll in shifting magnitude greater than or equal to half of the interval between the lines. The relative shift in axial direction of the work roll and the plane surface roll is performed continuously. The axially driving means drives one of the work roll and the plane surface roll in a shifting speed substantially lower than the line speed of metal strip in temper rolling process.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings:

FIG. 12 is a graph showing relationship between the depth of depression and the production cost;

FIGS. 13(a) and 13(*b*) are plan views showing variation of the pattern of unevenness to be formed on the surface of the metal plate;

FIG. 14 is a plan view of a sample piece on which unevenness is formed

FIGS. 25(*a*) and 25(*b*) are illustrations of the dull roll performing dulling operation at different shift positions;

DESCRIPTION OF THE PREFERRED EMBODIMENT

The preferred embodiment of a patterned metal plate is made of a steel plate. The steel plate to be produced according to the present invention, is formed of a plurality of unevenness, each constituted of conico-cylindrical projecting portion which projects from the general surface of the steel plate, and annular groove portion extending around the projecting portion. Each of the unevenness as the combination of the projecting portion and annular groove will be hereafter referred to as "uneven dot", throughout.

Though the specific embodiment of the patterned metal plate employs an uneven dot constituted of a conico-cylindrical projecting portion which projects from the general surface of the steel plate, and an annular groove portion extending around the projecting portion, having unit unevenness for forming an uneven pattern, configuration of the unit unevenness is not specified to the shown unevenness but can be of any appropriate or desired configurations. For example, the projecting portion can be of essentially polyhedric configuration if desired. Therefore, the following discussion with respect to the specific configuration of unit unevenness for constituting the desired uneven pattern should be appreciated as mere examples for implementing the present invention.

Figure 1:
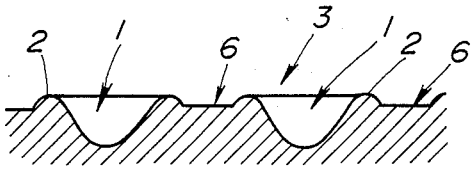
FIG. 1 is a partial section of a dull roll for forming the preferred embodiment of a metal plate according to the invention.
Figure 2:
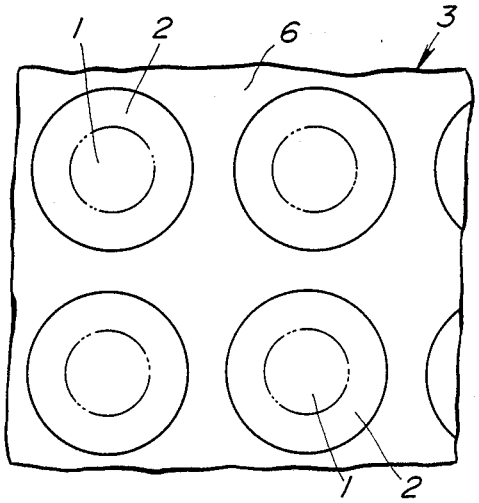
FIG. 2 is a developed plan view of the dull roll of FIG. 1.

A plurality of the uneven dots are aligned to each other in a predetermined pattern and at a predetermined density for forming a desired uneven pattern on the surface of the steel plate. Such uneven pattern is formed through a temper rolling process utilizing a dulled work roll 3 (FIGS. 1 and 2). The outer periphery of the work roll 3 is dulled to form a predetermined configuration of unevenness, each constituted by a depression 1 which essentially conforms of the conico-cylindrical projecting portion, and an annular projection 2 which conforms the annular groove of the metal plate. The combined depression 1 and the annular projection 2 as unit unevenness to be formed on the peripheral surface of the work roll will be referred to as "impression".

As seen from FIG. 1 and 2, the impressions are arranged in spaced apart relationship to each other with leaving blank areas 6, on which the impression is not formed and maintained flat. In other words, the impressions are spaced by the blank area 6.

In the preferred embodiment, the density $\eta(\%)$ of the uneven dot and the size D ($\mu$m) of the uneven dot are as follows:

$$10 \leqq D \leqq 300$$

$$30 \leqq \eta \leqq 100$$

The uneven dots are arranged to form one or more groups, each of which groups will be hereafter referred to an "uneven pattern unit". These uneven pattern units are arranged to form the desired uneven pattern with a section of the metal plate surface where the unevenness is not formed, which section is referred to as "general surface section". Each pattern unit occupies the area of the steel plate surface in circular form, belt-like form, polygon form and so forth. The minimum diameter or width of the uneven pattern unit is 1 mm. On the other hand, the general surface section may have width of 1 mm.

Therefore, the impressions to be formed on the work roll surface form one or more groups corresponding to the uneven pattern unit on the steel plate. The groups of impressions are arranged with leaving the section where the impression is not formed, in the pattern corresponding to the uneven pattern on the steel plate. The process of dulling the work roll to form the desired pattern of unevenness on the peripheral surface will be discussed herebelow.

In the preferred process, the peripheral surface of the work roll is subject to a grinding treatment for bright finishing, in advance of forming the impressions. Then, impressions are formed on the peripheral surface by irradiating high density energy beam. In the shown embodiment, a laser beam is selected as the high density energy beam for forming the impression on the peripheral surface of the work roll. Irradiating the laser beam onto the peripheral surface of the work roll 3, the material at the irradiating point is molten or fused to cause vaporization to form the depression 1 and the annular projection 2 around the depression.

The laser beam to be used for the dulling operation is in a range of 600 W to 2500 W. If the laser beam of lower than 600 W is used, the laser beam energy will be insufficient for satisfactorily fusing the material steel of the work roll to form the impression. On the other hand, when the laser beam energy becomes excessive to make the cost for the energy beam unnecessarily high. In addition, when the laser beam energy is greater than 2500 W, thermal deformation tends to occur on the lens in the laser machine to cause instability in the laser mode to cause difficulty in roughness control.

An assist gas, such as oxygen gas, may be discharged toward the laser beam irradiating point for assisting fusing of the material steel at the portion to form the depression. The assist gas may be discharged through an assist gas discharge nozzle which is inclined with respect to the plane laying substantially perpendicular to the axis of the laser beam. In the preferred layout, the assist gas discharge nozzle is in a range of 60° to 90°.

The laser machine to use the foregoing dulling operation may be so designed as to intermittently irradiate the laser beam with a predetermined interval. The laser machine may be intermittently shifted in a direction parallel to the axis of the work roll at a given magnitude. This shifting magnitude determines the axial pitch of the circumferentially aligned impressions to be formed on the periphery of the work roll. On the other hand, the work roll may be driven to rotate at a given rotation speed. With this rotation speed of the work roll and the intermittent interval of laser beam irradiation, the circumferential pitch of the impressions can be determined.

Figure 3:
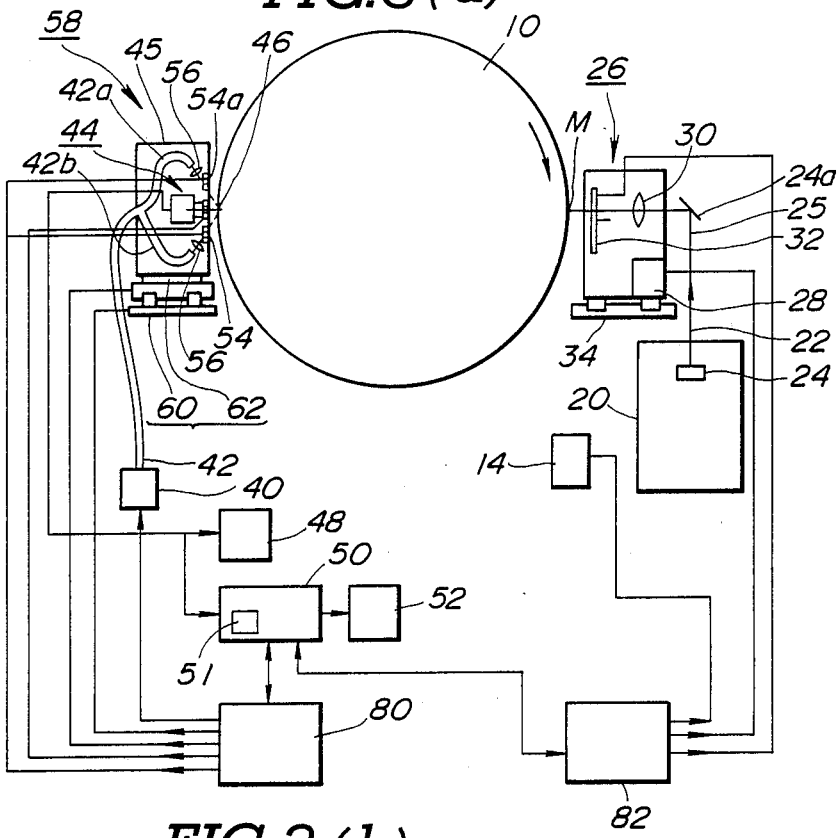
FIGS. 3(*a*) and 3(*b*) are is a schematic illustration of one example of a laser dulling device for performing laser dulling operation
Figure 3:
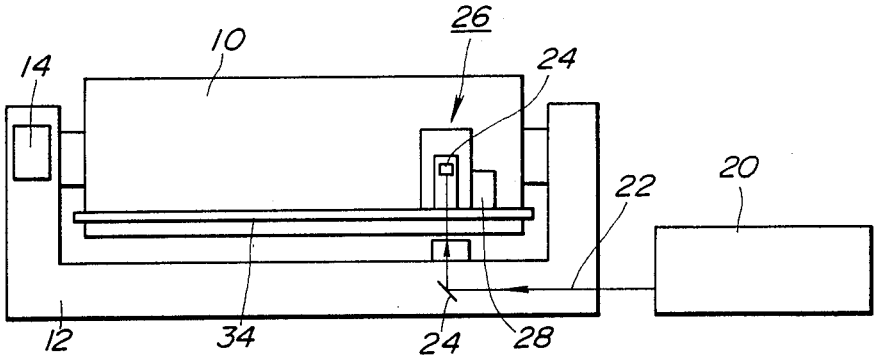

One example of the laser beam machining apparatus for performing the laser dulling operation to form the desired pattern is shown in FIGS. 3(*a*) and 3(*b*). In the shown example, the work roll 3 is rotatingly supported by means of a roll support 12. Though it is not clearly shown in FIGS. 3(*a*) and (*b*), the roll support 12 includes a driving mechanism to rotatingly drive the roll 3. The drive mechanism is associated with a rotation speed controller 14. The laser beam generator unit 20 is provided in the vicinity if the roll support. The laser beam generator unit 20 includes a deflector assembly 24 for deflecting the generated laser beam along a laser beam path 25. A deflector mirror 24*a* is inserted within the laser beam path 25 for deflecting the laser beam output from the baser beam generator unit 20 toward a laser head unit 26. The laser head unit 26 includes a lens assembly 30 for focusing the laser beam onto the predetermined spot on the peripheral surface of the work roll 3 and a rotary chopper 32. The rotary chopper 32 serves for generating a pulsatile laser beam to be irradiated onto the roll periphery. The laser head is mounted on a laser head base 34, on which a guide rail is mounted in substantially transverse fashion with respect to the longitudinal axis of the work roll. The laser head unit 26 is movable toward and away from the work roll surface along the guide rail by means of a drive device 28. On the other hand, the laser head base 34 is movable in a direction parallel to the longitudinal axis of the work roll 3. The drive mechanism comprises a spiral rod drivingly meshing with a laser head base for causing axial shifting of the base with the laser head unit 26 in a magnitude corresponding to the magnitude of rotation of the spiral rod.

In dulling operation, since the laser beam is focused and irradiated as substantially high density energy beam, the impressions are formed on the roll surface substantially at a moment. Namely, irradiation of the laser beam causes melting of the surface material to cause vaporization of the material at the laser beam irradiating spot to form the depression and the annular projection.

In order to adjust the interval of the impressions in circumferential and axial directions, a control system is provided. The control system includes a system for monitoring the surface condition of the work roll on which the dulling operation is performed.

The roll surface monitoring means includes a lighting device which includes a light source unit 40. As a light source unit 40, a stroboscopic light source is used. The light source unit is connected to a light path 42 which comprises an optical fiber. The light path 42 is bifurcated at the end into two branches 42*a* and 42*b*. Both of the branches 42*a* and 42*b* cooperate with an optical detector head unit 58 and directed to a common monitoring point M on the work roll surface. The optical detector unit 58 includes shutters 54*a* and 54*b* for establishing and blocking the light path from the end of the branches 42*a* and 42*b* of the light path 42 to the monitoring point M. In the preferred construction, the shutters 54*a* and 54*b* are open and closed synchronously to each other. On the other hand, the shutters 54*a* and 54*b* may be driven to open and close in an asynchronous manner.

The light beam may be irradiated from a common plane including normal extending from the roll surface. The irradiation point are selected on the aforementioned plane to be symmetric to each other with respect to the normal and to have an incident angle greater than or equal to 60°.

Opposing the monitoring point M. an image pick-up device 44 is provided. The image pick-up device employed in the shown construction is designed to pick-up an enlarged still image of the roll surface at the monitoring point. For automatically focusing the image pick-up device 44, an focusing device 46 may be combined with the image pick-up device and is connected to a display monitor unit 48 and an image data processing unit 50. The image data processing unit 50 processes the image data input from the image pick-up device 44 to derive an output signal. The output signal is then output via an output unit 52. The image data processing unit 50 is also connected to a timing control unit 80 and a laser control unit 82. The timing control unit 80 controls the irradiation timings of the light beam and image pick-up. On the other hand, the laser control unit 82 controls operation of the drive unit 28 for adjusting the irradiation point of the laser beam on the work roll surface and operation of the chopper 32 for adjusting laser beam irradiation timing and irradiation period.

On the other hand, the image pick-up device 44 is housed in a housing 45 which is mounted on a movable base. Guide 60 and 62 are provided for allowing movement of the housing 45 in transverse and axial directions. The housing 45 is associated with a drive means (not shown) to be driven toward and away from the monitoring point M along the guide 60. On the other hand, the housing 45 is driven by the driving means in axial direction along the guide 62. The axial movement of the housing 45 with the image pick-up device may be controlled in synchronism with axial movement of the laser head unit.

With the foregoing laser dulling system, the impressions can be formed on the peripheral surface of the work roll in the predetermined uneven pattern which corresponds to the uneven pattern to be formed on the steel plate surface through the temper rolling process.

The size of each individual impression can be controlled by intensity of the laser beam to be irradiated onto the surface of the work roll and the amount of the assist gas to be discharged toward the irradiating point of the laser beam.

The method and apparatus for dulling the work roll surface have been disclosed hereabove in terms of a specific example, however, the dulling operation for forming the predetermined patterns of impressions in various methods and apparatus. The methods and apparatus have been disclosed in the co-pending U.S. patent application Ser. No. 072,429, filed on July 13, 1987 which has been assigned to the common assignee to the present invention, and in the co-pending U.S. patent application Ser. No 084,283, filed on Aug. 11, 1987. Disclosures of these prior proposed apparatus and dulling methods are herein incorporated by reference for the sake of disclosure.

Though the shown embodiment is directed to the specific configuration of the impression to be formed on the surface of the work roll, namely that constituted by the center depression and the annular projection therearound, the configuration of the impression is not necessarily specified to the shown configuration. Namely, the annular projection is not necessarily a sequence of ring shaped configuration but can be two or more arc shaped projections discontinued with given interval. On the other hand, the projection around the depression is not always necessary. In case that only depression is to be formed, the amount of the assist gas to be discharged toward the laser beam irradiating point will be so adjusted as not to cause re-solidification of the vaporized material around the upper edge portion of the depression.

Figure 4:
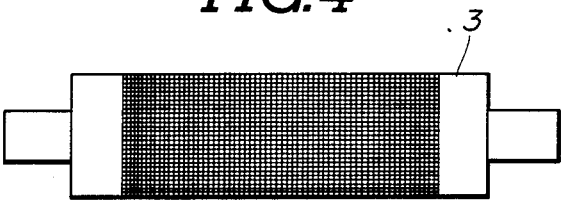
FIG. 4 is a front elevation of the dull roll of FIG. 1.
Figure 5:
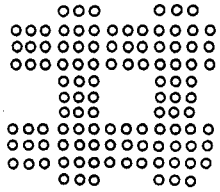
FIG. 5 is an explanatory illustration showing one example of pattern of unevenness formed on the dull roll.

FIG. 4 shows an overall plan view of the work o roll formed with the predetermined uneven pattern. In FIG. 4, each of the line illustrated by the solid line on the work roll surface comprises each group of impressions circumferentially and axially aligned according to the desired pattern. On example of the pattern to arrange the impressions in the groups is shown in FIG. 5. As seen from FIG. 5, each group of the impressions on the work roll surface is constituted by a plurality of impressions aligned in circumferential direction with a given intervals and axially arranged in a given pitch.

Figure 6:
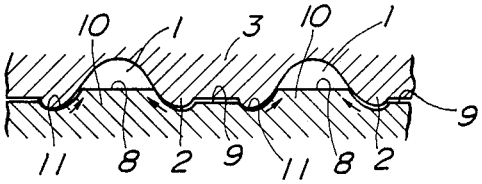
FIG. 6 is a section showing the process in forming patterned unevenness on the metal plate by means of the dull roll of FIGS. 1 through 4.

With the work roll constructed as set forth above, a temper rolling operation is performed. During this temper rolling process, the uneven pattern formed on the work roll surface is transferred to the steel plate surface through the process shown in FIG. 6. Namely, the work roll 3 depresses the steel plate surface. By the pressure to be exerted by the work roll 3, the portion of the steel plate which mates with the annular projection 2 of the impression is depressed to form the annular groove II with rounded taper section 11 sending toward the top of the conico-cylindrical projection 10. The material causes plastic flow of fiber toward the portion mating the depression 1 of the impression of the work roll 3, as shown by arrow in FIG. 6. Therefore, the conico-cylindrical projection 10 with a flat top surface 8 is formed.

During this temper rolling operation, the portion of the steel plate 7 which mates the plane peripheral surface where the impression is not formed, is left as general surface section 9. As seen from FIG. 7, due to plastic material flow toward the portion where the conico-cylindrical projection 10 is formed, the elevation of the flat top surface 8 of the conico-cylindrical projection 10 becomes higher than that of the general surface section 9.

Figure 7:
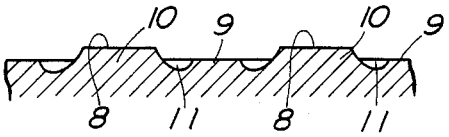
FIG. 7 is a section of the metal plate formed with the unevenness through the rolling process as illustrated in FIG. 6.
Figure 8:
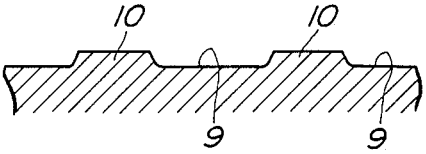
FIG. 8 is a section showing another example of configuration of unevenness formed on the metal plate surface.

As set forth above, the configuration of the uneven dot to be formed on the steel plate 7 is not specified to the configuration shown in FIG. 7. For example, if the annular projection is not formed around the depression, the configuration of the uneven dot to be formed during the temper rolling process becomes to have only conico-cylindrical projection as shown in FIG. 8.

Figure 9:
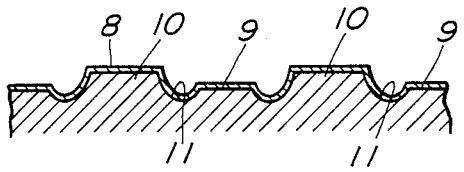
FIG. 9 is a section of the patterned metal plate of FIG. 8, which is coated by a plating layer.

The steel plate which is formed the predetermined uneven pattern through the temper rolling process, is then subject surface treatment, as shown FIG. 9. In the preferred process, the surface treatment is performed by tin plating, chromium plating or galvanization to provide corrosion resistance and weather resistance for the steel plate. In addition, by plating of tin, chromium or zinc, the uneven pattern on the surface of the steel plate becomes definite to provide good decorative appearance.

If necessary, a transparent resin coating layer may be formed on the plating layer so as to further provide better corrosion resistance and weather resistance for the steel plate.

In the plating process, since the steel plate formed with the uneven pattern in the preferred process as set forth above, has greater flat area than that of the steel plate which is formed unevenness on the surface by way of shot blasting or electric spark erosion, surface area becomes smaller than that of the latters. As a result, the required amount of the plating material becomes smaller. In other words, with the equal amount of the plating material, the steel plate according to the present invention can be formed thicker plating layer. This clearly provides better corrosion resistance and weather resistance in comparison with that treated by shot blasting or spark hardening. Furthermore, as is well shown, in case of electro-plating, intensity of plating current becomes higher at the projecting portion than that in the general section or depression. Therefore, in the shown configuration of the unit dot, the thickness of the plating layer in various section becomes:

$$T_1 \geqq T_2 < T_3$$

where $T_1$ is thickness of plating layer at the top 8 of the conico-cylindrical projection 10;

$T_2$ is a thickness of the plating layer at the general surface section 9; and $T_3$ is a thickness of the plating layer at the depression 11.

This variation of thickness of the plating layer at various sections of the uneven dot, provide advantage in exhibiting better corrosion resistance, weather resistance and in addition, wear resistance, since the top of the projection tends to be exposed to the environment. For instance, when such steel plate is used for forming a steel container, the top 8 of the conico-cylindrical projection tends to contact with the content in the container is subject to wearing. This also prevents the bare material of the steel plate from being exposed and thus provide better rust-proof effect.

Figure 10:
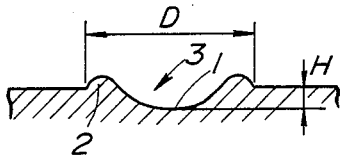
FIG. 10 is an enlarged partial section of the dull roll to show the dimensions of the unevenness formed on the peripheral surface thereof.
Figure 11:
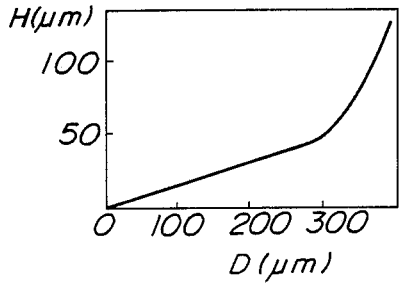
FIG. 11 is a graph showing relationship between the depth and diameter of the depression of the unevenness formed on the metal plate surface.

Here, discussion will be given with respect to the preferred uneven pattern to be formed on the surface of the steel plate. In order to make the following discussion to be easily understood, FIG. 10 shows the dimensional relationship of each impression to be formed on the work roll. As seen from FIG. 10, the external diameter of the annular projection 2 which defines the border between the impression and the general surface section and thus defines the diametrical size of the impression, is D μm and the depth from of the depression is H μm. As will be naturally appreciated, when the diameter D is increased, the depth H of the depression is also increased. In the experiment, it was found that, when the diameter D becomes greater than 300 μm, magnitude of increase of the depth becomes significant.

In general, temper rolling is performed for shape correction and surface tempering. In order to accomplish both, relatively high pressure should be exerted between the work roll and the steel plate. This leads to a higher transfer rate of the impression onto the steel plate surface. Therefore, when the diameter of the impression is large and thus the depth of the impression becomes deep, the conico-cylindrical projection to be formed on the steel plate surface becomes substantially high. As set out, in order to form a higher conico-cylindrical projection, greater amount of plastic material flow is required. Therefore, when the height of the projection to be formed is excessively high, substantially small defects tends to be formed around the projection. In this view, the maximum diameter of the impression is set at 300 μm. On the other hand, when the diameter D of the impression is too small, uneven pattern on the steel plate cannot be definitely recognized even when the impression is provided at high density. Especially, when the diameter D becomes smaller than 10 μm, the formed uneven pattern on the steel plate becomes indefinite. Therefore, the minimum diameter of the impression is set at 10 μm.

It will be appreciated that the uneven pattern on the steel plate will not be recognized by the size of the uneven dot to be formed but by density of the uneven dots and presence or absence thereof. Therefore, substantially height of the uneven dot is not required.

On the other hand, in view of the cost, it is not economical to form the deep depression since deep depression requires greater grinding magnitude in reproduction. This increases production cost or cost for treatment of the work roll. Cost for treatment of the work roll in relation to the diameter of the impression to be formed is shown in FIG. 12. In FIG. 12, Solid line represents a roll cost of the work roll and broken line represents treatment cost. As will be seen from FIG. 12, when the diameter D becomes greater than 300 μm, the roll cost increases substantially.

Therefore, in this view, it is preferred to limit the diameter D of the impression to be smaller than or equal to 300 μm.

On the other hand, the relative area η (%) of the impression can be defined by the diameter D of the impression and the center-to-center distance Sm μm between adjacent impressions. The relative area η can be given by the following equation:

In case Sm>D $$\eta = \frac{\pi}{4}\left(\frac{D}{Sm}\right)^2 \tag{1}$$

In case Sm<D $$\eta = \frac{\pi}{4}\left(\frac{D}{Sm}\right)^2 - \left(\frac{D}{Sm}\right)^2 \cos^{-1}\left(\frac{Sm}{D}\right) + \sqrt{\left(\frac{D}{Sm}\right)^2 - 1} \tag{2}$$

On the other hand, the density N (number of impressions in a unit area (1 mm²)) can be obtained from the following equation:

$$N = \left(\frac{1000}{Sm}\right)^2 \tag{3}$$

From the foregoing equations (1), (2), and (3), the following equation can be obtained:

In case Sm≧D $$\eta = \frac{\pi}{4 \times 10^6} D^2 \cdot N$$

In case Sm<D $$\eta = \frac{\pi}{4 \times 10^6} D^2 \cdot N - \frac{1}{10^6} D^2 \cdot N \cos^{-1}\left(\frac{10^3}{\sqrt{N} \cdot D}\right) + \sqrt{\frac{1}{10^6} D^2 \cdot N - 1}$$

Assuming the diameter D of the impression is constant, the relative area η becomes proportional to the density N of the impressions. In order to determine the optimal density and thus optimal relative area of the impressions, experiments were conducted.

In the experiment, sample pieces had a size of 100 mm×100 mm. The sample piece is shown in FIG. 14. In FIG. 14, a denotes general surface section, b, c and d shows sections in which impressions are formed. Size of the sections b, c and d are respectively 0.5 mm×0.5 mm, 1.0 mm×1.0 mm and 1.5 mm×1.5 mm. In the experiments, samples pieces having mutually different surface roughness Ra in the sections a were prepared. The surface roughness Ra of respective sample pieces were 0.05 μm. 0.13 μm. 0.25 μm, 0.35 μm and 0.45 μm. On the other hand, in the sample pieces, the relative area η were varied to 100%, 80%, 55%, 30% and 10%. Therefore, total 25 different combinations in surface roughness and relative area, of sample pieces were provided for testing definiteness of the uneven pattern. With these samples pieces, a recognition test was performed. In the recognition test, three testers having sight of 1.0 to 1.5 performed the test to see whether the uneven pattern formed on respective sample piece can be recognized or not, under a 200 lux of illumination and at a distance of 30 cm. from the sample pieces.

Figure 15:
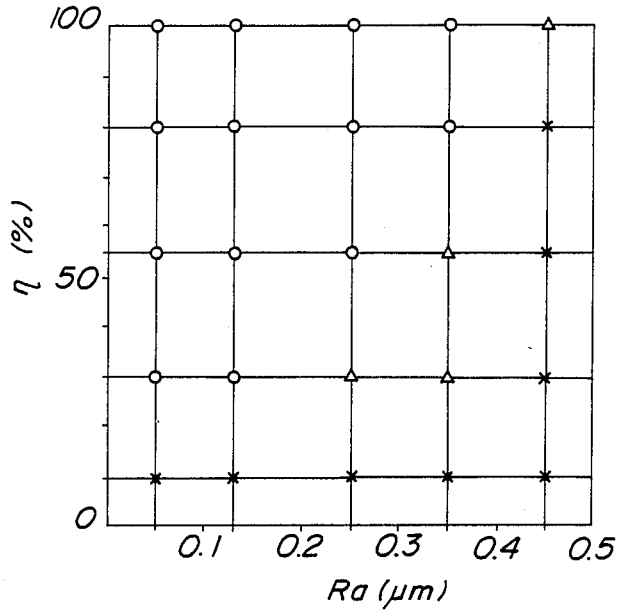
FIG. 15 is a chart showing relationship between pitch of the depression to be formed on the metal plate surface and the surface roughness of the plate.

The result of the recognition test is shown in FIG. 15. In FIG. 15, the vertical axis represents the relative area η of the uneven dots and the horizontal axis represents the surface roughness Ra of the general surface section. In addition, the sign o indicates that all three tester recognized, the sign Δ indicates that two among three testers recognized and x indicates that none of the testers was recognized.

In the experiments, in case of the section b, none of the testers could recognize the uneven pattern. On the other hand, in case of the section c and the section d, substantially the same results were obtained. Therefore, only results obtained with respect to the section is shown in FIG. 15. From the result as illustrated, it is appreciated that when the relative area $\eta$ is greater than or equal to 30% and the surface roughness Ra of the general surface section is lower than or equal to 0.04 $\mu$m. recognition of the dulled section on which the uneven pattern is formed, could be made. It is further appreciated that better recognition could be obtained when the relative area $\eta$ is greater than or equal to 30% and the surface roughness Ra of the general surface section is lower than or equal to 0.02 $\mu$m.

Figure 16:
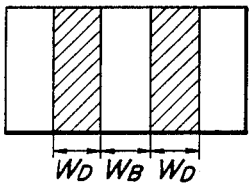
FIG. 16 is a plan view of one example of test piece to be utilized for testing distinctness of the uneven pattern to be formed on the metal plate surface.

Another experiment was performed utilizing sample pieces which were provided with section formed with unevenness pattern in a width of W, as shown in FIG. 16. A check was performed whether the uneven pattern could be recognized or not. Ratio of area $W_B$ of the section where no unevenness was formed and area $W_D$ of the section where uneven pattern was formed were equal. The method of judgement was substantially the same as that in the former test.

The area ratio of the area occupied by the unevenness in the dulled section was 30% and the surface roughness of the general section where unevenness is not formed, was 0.40 $\mu$m. The result of the recognition test performed under the foregoing condition is shown in the appended table 1. As seen from the appended table 1, when the width of the general section interpositioned between the dulled sections is greater than or equal to 1 mm, the dulled section could be recognized.

EXAMPLE 1

Figure 17:
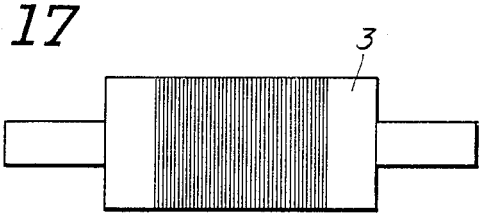
FIG. 17 is a plan view of one embodiment of a skin pass roll to be utilized for performing the preferred embodiment of dulling process for forming the desired pattern of unevenness on the surface of the metal plate.
Figure 18:
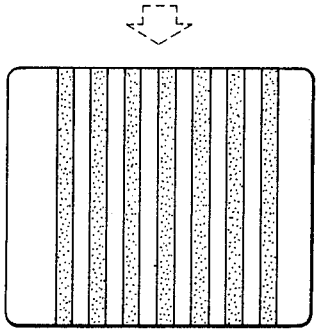
FIG. 18 is an enlarged plan view of a portion of the outer periphery of the skin pass roll of FIG. 17.
Figure 19:
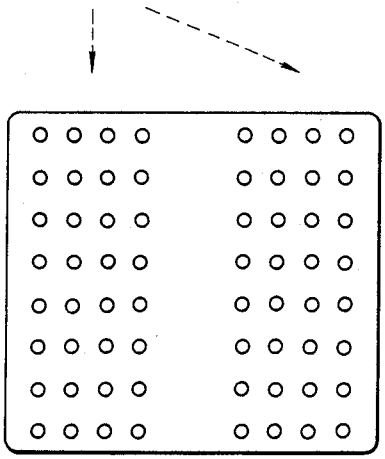
FIG. 19 is a further enlarged plan view of a portion of the outer periphery of the skin pass roll of FIG. 18.

For experimentation, dulling treatment was performed for the temper roll, which has surface roughness Ra of 0.05 $\mu$m in the general section. Through dulling operation, uneven pattern to be transferred to the metal plate was formed on the peripheral surface. The uneven pattern was constituted by a plurality of impressions having diameter of 150 $\mu$m and pitch of 240 $\mu$m between adjacent impressions. Area ratio of the area occupied by the impressions in the dulled section was 30.6%. The uneven pattern formed on the temper roll is shown in FIGS. 17, 18 and 19.

The temper roll prepared as above, was set in a final stand of double-stand temper rolling mill. Temper rolling was then performed for a steel coil of the size 0.20×794 mm at a reduction of 1.3%. Uneven pattern transfer rate was 98%. The uneven dot formed on the steel coil through the temper rolling process, had surface roughness Ra of 1.18 $\mu$m. After temper rolling process, the coil was separated into two pieces. One of the pieces was thereafter processed by tin plating to make an electrolytic tin plate of 5.6 g/m$^2$. For the other piece, chromium plating was performed to make an electrolytic chromium plate of 130 mg/m$^2$. In either case, clear uneven patterns could be recognized after plating process.

EXAMPLE 2

Figure 20:
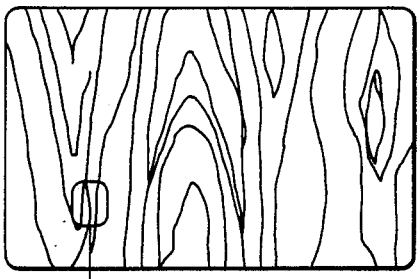
FIG. 20 is a plan view of another embodiment of a skin pass roll to be utilized for performing the preferred embodiment of dulling process for forming the desired pattern of unevenness on the surface of the metal plate.
Figure 21:
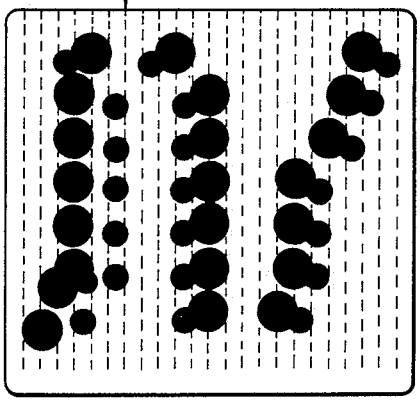
FIG. 21 is an enlarged plan view of a portion of the outer periphery of the skin pass roll of FIG. 20.

For the temper roll having surface roughness Ra of 0.05 $\mu$m, graining uneven pattern was formed, which uneven pattern was constituted by impressions of diametrical size of 10 to 300 $\mu$m. The temper roll formed with the graining uneven pattern is shown in FIGS. 20 and 21.

The graining uneven pattern was formed by non-linear lines defined by impressions arranged along the line with area ratio of 55%. The distance between the lines are set greater than or equal to 1 mm.

The temper roll thus prepared was set in a single stand temper rolling mill for performing temper rolling for annealed stainless steel (SUS304) with draft of 1.0%. Observing the resultant patterned stainless steel plate, no defect in the transferred graining uneven pattern at the surface side and the reverse or back side surface was maintained substantially plane. Furthermore, as observed, the graining pattern formed on the surface of the stainless steel plate was definite.

COMPARATIVE EXAMPLE 1

In order to compare with the patterned plates made through the preferred embodiments, comparative experiments were performed. In the comparative example 1, temper rolling was performed by means of the temper roll which was dulled through the conventional photo-etching process. In this case, unless the impression having depth deeper than 100 $\mu$m, the uneven pattern to be transferred onto the steel plate which is identical to that used in the foregoing example 1, was not definite. In addition, another experiment was performed by utilizing emboss film attached onto the outer periphery of the temper roll, which emboss film was formed with stripe uneven patter as shown in FIGS. 17, 18 and 19. In this case, due to roll curve, the stripe transferred onto the steel strip could not be in straight.

For making comparative samples, the temper roll with the uneven pattern constituted by a plurality of impressions, each of which had depth of 120 $\mu$m. With this temper roll, temper rolling was performed for the material steel strip the same as that used in the foregoing example 1 was performed in substantially the same process. The resultant steel plate had unevenness on the back side. In addition, the uneven pattern transferred on the surface side was not satisfactorily definite.

COMPARATIVE EXAMPLE 2

In order to compare with the foregoing example 2, the temper roll with graining uneven pattern was prepared, which graining uneven pattern was formed by photo-etching process to have depth of 120 $\mu$m in each impression. The non-linear lines in the graining uneven pattern formed on the temper roll project from the general surface.

Defects in line or lines forming the graining pattern was observed after rolling of stainless strip in a length of 2 km. Furthermore, at the initial stage of temper rolling, unevenness was formed even at the back side of the plate.

As will be clear from this, the metal plate with the uneven pattern formed according the preferred process according to the present invention can exhibit excellent appearance with high corrosion resistance and weather resistance.

In case of the multi-roll temper rolling mill, the uneven pattern on the work roll tends to be transferred on the peripheral surface of a back-up roll and/or an intermediate roll since the back-up roll is pressed onto the peripheral surface of the work roll. When the work roll is changed for changing the uneven pattern to be formed on the metal strip, the uneven pattern formed on the back-up roll and/or the intermediate roll is transferred to the work roll through the temper rolling process to overlap with the desired uneven pattern. This overlapping uneven pattern will be transferred from the work roll to the metal strip to degrade the quality of the uneven patterned metal strip and the appearance thereof.

In order to avoid this, a grinding process is performed for the back-up roll and/or the intermediate roll for removing the surface portion or outer skin portion of the rolls by means of sand-paper, whetstone and so forth. During this grinding process, the temper rolling mill is necessarily stopped. This lowers efficiency. In addition, when the unevenness on the peripheral surfaces of the back-up roll and/or the intermediate roll are relatively deep, the uneven portion on the surface of the rolls cannot be removed completely even by the grinding process.

The present invention additionally provides a method and apparatus for avoiding the aforementioned defects and thus for maintaining satisfactorily high efficiency and high yield in production of satisfactorily high quality patterned metal strip or plate.

The preferred embodiment of a temper rolling mill suitable for implementing the preferred process of temper rolling according to the present invention, will be discussed herebelow with reference to FIGS. 22 to 29.

Figure 22:
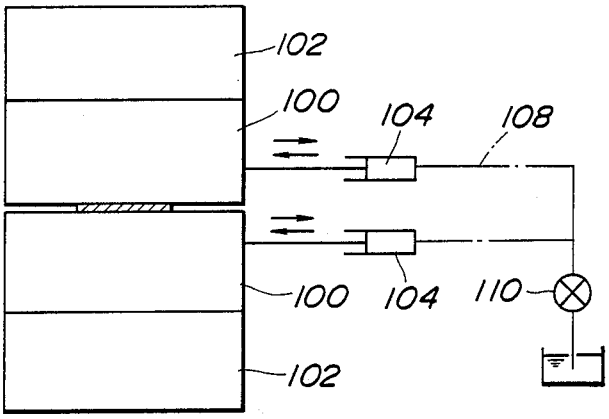
FIG. 22 is a fragmentary illustration of a temper rolling mill to perform the preferred process for forming desired pattern on the metal plate surface.

FIG. 22 shows the first embodiment of a four-roll type temper rolling mill to implement the preferred process for forming the uneven pattern on the metal strip.

The four-stand type temper rolling mill comprises the work rolls 100 formed with the uneven pattern through the laser dulling process as set forth above. In the shown embodiment, the stripe uneven pattern having a plurality of stripe lines extending circumferentially, is formed on the work roll surface. The stripe lines are formed in parallel to each other and spaced away from the adjacent stripe lines with a given distance b mm. The temper rolling mill also has back-up rolls 102 which provide back pressure for respectively corresponding work roll. The work rolls 100 are associated with hydraulic cylinders 104. The hydraulic cylinders 104 are respectively designed to drive the corresponding work rolls 100 in axial direction. The shifting magnitude a mm of the work roll 100 is so selected as to be greater than or equal to half of the distance -b mm between the stripe lines, each of which is formed by the dulled section.

The hydraulic cylinders 104 are cyclically and synchronously driven for causing axial shift by a predetermined distance. In the alternative, it may be possible to continuously drive the work roll for axial shifting.

Figure 23:
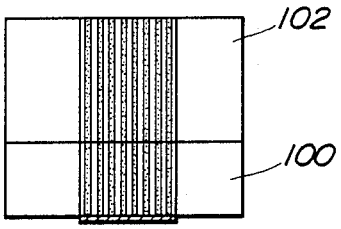
FIG. 23 is an explanatory illustration shown process in transferring of the uneven pattern on the dull roll to a back-up roll.
Figure 24:
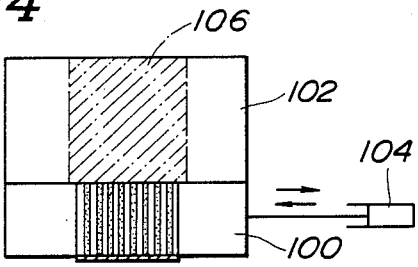
FIG. 24 is an explanatory illustration of the dull roll performing dulling operation.

If the work roll 100 is not shifted in axial direction throughout the temper rolling mill operation, the uneven stripe pattern is transferred onto the back-up roll surface through the temper rolling operation, as shown in FIG. 23. On the other hand, by axial shifting of the work roll 100 relative to the back-up roll 102, the relatively wide range of depressed section 106 is formed on the back-up roll, as shown in FIG. 24. This makes the depth over the depressed Section 106 substantially even. Therefore, it becomes unnecessary to perform grinding process even when the work roll is changed.

In the preferred process, the hydraulic cylinder 104 is connected to a pressurized working fluid source via a pressure line 108. A three-way flow control valve 110 may be provided in the pressure line 108 for adjusting the fluid pressure for driving the work roll 100 in the axial direction. The drive speed of the hydraulic cylinder 104 in axial direction is substantially lower in comparison with the line speed of the metal strip. For instance, the speed of axial shifting of the work roll is so selected as to be about 1/1000 of the line speed. Therefore, the offset of the stripe lines of the uneven pattern formed on the metal strip is not noticeable. Consequently, the hydraulic cylinder 104 is driven continuously to continuously shifting the work roll in axial direction.

The shifting magnitude a mm of the work roll 100 is necessarily greater than the axial width b mm of the interval between stripe lines. When the shifting magnitude a mm is smaller than half of the width b mm of the interval, non-deformed section 112 in a width c mm (b/2(mm)−a(mm)) will be remained, as shown in FIG. 25(*a*). This uneven pattern tends to be transferred to the work roll. In this view, so as to maintain the peripheral surface of the work roll substantially even by uniformly depressing the overall area, as shown in FIG. 25(*b*), the shifting magnitude a mm of axial shift of the work roll 100 must be greater than b/2 mm.

In order to effect axial shifting of the work roll in view of maintenance of the back-up roll and/or the intermediate roll, experiments were performed utilizing double-stand type temper rolling mill with the hydraulic work roll shifting device as set forth above. As a No. 1 stand roll, plane surface bright roll having i , surface roughness of 0.16 to 0.18 μm Ra was used. As a No. 2 stand roll, the work roll with laser dulled uneven pattern was used. Temper rolling was performed in a draft of 0.8±0.2%. The width of each uneven stripe formed on the work roll was 5 mm. Width of the interval between the uneven stripes were varied in 2 mm, 5 mm, 10 mm and 15 mm. The axial shifting magnitude of the work roll 100 was set in a magnitude of 5 mm. The hydraulic cylinder 104 was continuously driven to thrustingly shift the work roll so that the uneven pattern formed on the metal strip forms a sine curve. The one cycle of thrusting shift of the work roll was set for 1000 m of the metal strip length. On the other hand, the temper rolling was performed at a line speed of 500 mpm.

After temper rolling, the surface condition of the bright roll which served as the back-up roll was checked. The result of observation of the back-up roll surface is shown in the appended table 2.

In order to compare these result, a comparative experiment was performed to perform temper rolling without shifting the work roll.

As seen from the appended table 2, as long as the width of the interval between the uneven stripes is smaller than twice of the axial shifting magnitude of the work roll, no maintenance was required. Therefore, when necessity of changing uneven pattern occurs, grinding process or replacement of the back-up roll was not required. When the axial shifting magnitude of the work roll is smaller than ½ of the width of the interval of the uneven stripes, grinding process was required to remove the non-depressed projecting sections to make the back-up roll surface substantially even. On the other hand, when the work roll is not shifted, replacement of the back-up roll was necessary when changing the work roll having different uneven pattern to the former one.

Figure 26:
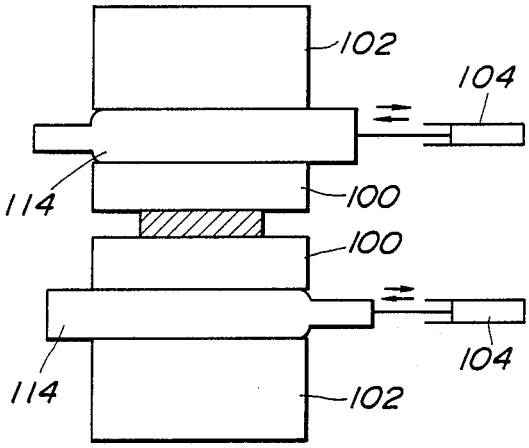
FIG. 26 is a fragmentary illustration of another embodiment of temper rolling mill for performing dulling operation to produce the preferred embodiment of the patterned metal plate.

FIG. 26 shows another embodiment of the temper rolling mill to implement the preferred temper rolling process according to the present invention. The shown embodiment is directed to six-roll type temper rolling mill including a pair of work rolls 100, a pair of back-up rolls 102 and a pair of intermediate rolls 114. In this embodiment, the hydraulic cylinders 104 are associated with the intermediate rolls 114 for driving the latter to cause axial shifting.

Figure 27:
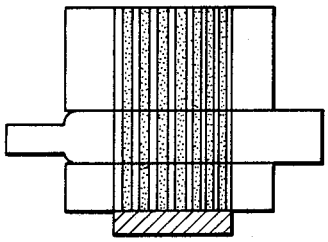
FIG. 27 is an illustration showing process of transferring the uneven pattern on the dull roll to an intermediate roll.

As will be appreciated, the uneven pattern on the work roll 100 is transferred to the intermediate roll 114 and subsequently to the back-up roll 102. Therefore, when all of the work roll 100, the intermediate roll 114 and the back-up roll 104 are maintained in fixed relationship to each other, the uneven patterns as shown in FIG. 27 will be formed on the intermediate roll 114 and the back-up roll 104. In this case, when the work roll is changed to change the uneven pattern to be formed on the metal strip, the uneven pattern on the back-up roll 104 and the intermediate roll 114 is necessarily transferred to the work roll. Therefore, the uneven pattern of the former work roll overlaps with the desired uneven pattern of the current work roll. This apparently degrades the appearance of the metal plate to be formed.

Figure 28:
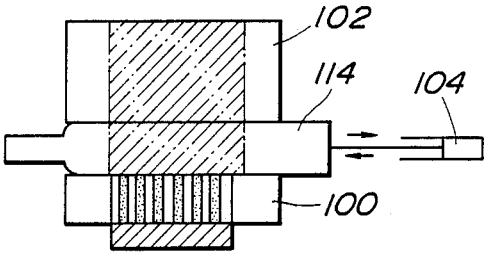
FIG. 28 is an explanatory illustration of the dull roll performing dulling operation.

This defect can be eliminated by shifting one of the work rolls and the intermediate roll in an axial direction to make the rate of formation of unevenness on the intermediate roll and back-up roll even through the overall periphery. Namely, by shifting the intermediate roll 114, the unevenness to be formed on the intermediate roll becomes at substantially even height through the overall surface, as shown in FIG. 28. This unevenness is transferred to the back-up roll to transfer the uneven pattern. Therefore, since the intermediate roll surface and the back-up roll surface are maintained substantially planar, grinding process or replacement of the back-up roll and/or the intermediate roll upon changing of the uneven pattern to form on the metal strip, becomes unnecessary.

Figure 29A:
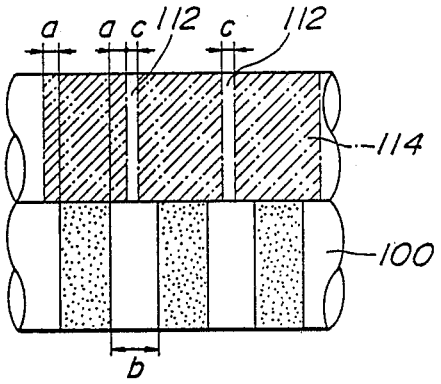
FIGS. 29(*a*) and 29(*b*) are illustrations of the dull roll performing dulling operation at different shift positions.
Figure 29B:
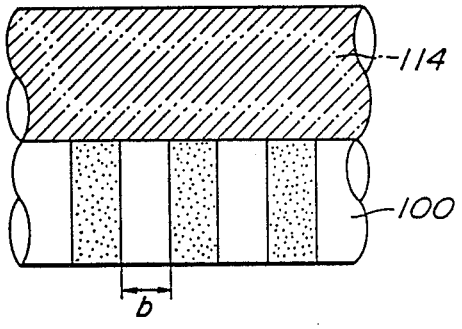

Similarly to the foregoing embodiment, the shifting magnitude a mm of the intermediate roll 114 is necessarily greater than the axial width b mm of the interval between stripe lines. When the shifting magnitude a mm is smaller than half of the width b mm of the interval, non-deformed section 112 in a Width c mm (b/2(mm)−a(mm)) will be remained, as shown in FIG. 29(*a*). This uneven pattern tends to be transferred to the work roll. In this view, so as to maintain the peripheral surface of the intermediate roll substantially even by uniformly depressing the overall area, as shown in FIG. 29(*b*), the shifting magnitude a mm of axial shift of the intermediate roll 114 must be greater than b/2 mm.

In order to effect axial shifting of the intermediate roll in view of maintenance of the back-up roll and/or the intermediate roll, experiments were performed utilizing double-stand type temper rolling mill with the hydraulic intermediate roll shifting device as set forth above. As a No. 1 stand roll, plain surface bright roll having surface roughness of 0.16 to 0.18 μm Ra was used. As a No. 2 stand roll, the work roll with laser dulled uneven pattern was used. Temper rolling was performed in a draft of 0.8±0.2%. The width of each uneven stripe formed on the work roll was 5 mm. Width of the interval between the uneven stripes were varied in 2 mm, 5 mm, 10 mm and 15 mm. The axial shifting magnitude of the intermediate roll 114 was set in a magnitude of 5 mm. The hydraulic cylinder 104 was continuously driven to thrustingly shift the intermediate roll so that the uneven pattern formed on the metal strip forms a sine curve. The one cycle of thrusting shift of the intermediate roll was set for 800 m of the metal strip length. On the other hand, the temper rolling was performed at a line speed of 500 mpm.

After temper rolling, the surface condition of the bright rolls which served as the back-up roll and the intermediate roll were checked. The result of observation of the back-up roll surface is shown in the appended table 3.

In order to compare these result, a comparative experiment was performed to perform temper rolling without shifting the intermediate roll.

As seen from the appended table 3, as long as the width of the interval between the uneven stripes is smaller than twice of the axial shifting magnitude of the intermediate roll, no maintenance was required. Therefore, when necessity of changing uneven pattern occurs, grinding process or replacement of the back-up roll was not required. When the axial shifting magnitude of the intermediate roll is smaller than ½ of the width of the interval of the uneven stripes, grinding process was required to remove the non-depressed projecting sections to make the back-up roll surface substantially even. On the other hand, when the intermediate roll is not shifted, replacement of the back-up roll was necessary when changing the work roll having different uneven pattern to the former one.

As will be seen herefrom, the temper rolling mill according to the present invention, provides easy maintenance of the intermediate roll and the back-up roll and expands the life of the rolls since no grinding process may be performed for long duration.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| Result | X | X | Δ | Δ | O | O | O |
|---|---|---|---|---|---|---|---|
| $W_B = W_D$ (mm) | 0.2 | 0.4 | 0.6 | 0.8 | 1.0 | 1.2 | 1.4 |

TABLE 2

| Shift of Work Roll | a mm | b mm | b/2 mm | Unevenness Transferred |
|---|---|---|---|---|
| Shift | 5 | 2 | 1 | Light (Maintenance not required) |
| Shift | 5 | 5 | 2.5 | Light (Maintenance not required) |
| Shift | 5 | 10 | 5 | Light (Maintenance not required) |
| Shift | 5 | 15 | 7.5 | Maintenance required |
| Not shift | — | 5 | 2.5 | Roll replacement required |

TABLE 3

| Shift of Intermediate Roll | a mm | b mm | b/2 mm | Unevenness Transferred |
|---|---|---|---|---|
| Shift | 5 | 2 | 1 | Light (Maintenance not required) |
| Shift | 5 | 5 | 2.5 | Light (Maintenance not required) |
| Shift | 5 | 10 | 5 | Light (Maintenance not required) |
| Shift | 5 | 15 | 7.5 | Maintenance required |
| Not shift | — | 5 | 2.5 | Roll replacement required |

We claim:

1. An uneven patterned metal plate having a surface, on which a visual decorative uneven pattern is formed by at least one pattern unit, said plate having a plurality of pattern units, said pattern units being separated from each other by unpatterned plane areas free of uneven patterns, each of said pattern units being constituted by and with a plurality of uneven dots, each of which has a size D, said uneven dots being arranged in a predetermined density to have a given ratio $\eta$ of the occupied area versus the plane area in said pattern unit, said plane area having a surface roughness Ra which is equal to or less than 40 $\mu$m, said size D and area ratio $\eta$ being in the range of:

$$10 \leqq D \leqq 300\ (\mu m)$$

$$30\eta \leqq 100\ (\%)$$

and wherein the size of said pattern unit has a minimum axial length or width equal to or greater than 1 mm.

2. A process for forming an uneven pattern on a metal strip comprising the steps of:

providing a work roll for temper rolling having a surface roughness Ra which is smaller than or equal to 0.40 $\mu$m;

performing a dulling operation for forming a desired visually decorative uneven pattern on said metal strip, which visually decorative uneven pattern is formed by at least one pattern unit constituted by and with a plurality of uneven dots, each of which has a size D, said uneven dots being arranged in a predetermined density to have given ratio $\eta$ of the occupying area versus the plane area in said pattern unit, said size D and area ratio $\eta$ being in the range of:

$$10 \leqq D \leqq 300\ (\mu m)$$

$$30 \leqq \eta \leqq 100\ (\%)$$

and the size of said pattern unit is at least 1 mm in axial length or width; and setting the dulled work roll in a temper rolling mill and performing temper rolling for tempering and transferring said uneven pattern onto the surface of said metal strip.

3. A metal plate having a surface with a visual decorative pattern which is constituted with a plurality of pattern segments, each of said pattern segments including a plurality of dots comprising a depression, a projection or a combination of a depression and a projection, each individual dot being of the size D, and said dots being arranged in said each pattern segment at a predetermined density to provide a given ratio $\eta$ of occupying area versus plane area in said pattern segment, said size D and area ratio $\eta$ being in the range of:

$$10 \leqq D \leqq 300\ (\mu m)$$

$$30 \leqq \eta \leqq 100\ (\%)$$

and said size of said pattern segment being greater than or equal to 1 mm in axial length and/or in width.

4. A metal plate having a surface with a visually decorative pattern which is constituted with a plurality of pattern segments, each of said pattern segments including a plurality of dots comprising a combination of an essentially circular projection and an annular depression surrounding said depression, each individual dot being in the size D, and said dots being arranged in each pattern segment at a predetermined density to provide a given ratio $\eta$ of occupying area versus plane area in said pattern segment, said size D and area ratio $\eta$ being in the range of:

$$10 \leqq D \leqq 300\ (\mu m)$$

$$30 \leqq \eta \leqq 100\ (\%)$$

and said size of said pattern segment being greater than or equal to 1 mm in axial length and/or in width.

5. A laminated patterned metal plate the surface of which includes flat areas and a multiplicity of impressions arranged in groups in accordance with a predetermined geometric pattern on the surface of said plate, said impressions including raised portions and depressed portions extending respectively outwardly and inwardly of said flat areas, and said impression having a size D which is the dimension of said peak portion and which is in the range of 10 to 300 $\mu$m, said impression having a surface occupation density which is the ratio of plate surface area occupied by said impressions to surface area unoccupied by said impressions, and which is 30–100%.

said patterned groups having minimum lengths and widths in the range of 1 mm or greater, and a surface lamination applied to said plate surface, said lamination being thicker at said flat areas than in said depressions.

6. The patterned metal plate defined in claim 5 wherein said surface lamination is a metal.

7. The patterned metal plate defined in claim 5 wherein said surface lamination is a resin coating layer.

8. The patterned metal plate defined in claim 5 wherein the surface lamination is also thicker at said raised portions than at said flat areas.

9. A metal plate having a substantially flat surface provided with a specially patterned plane area, the surface of said plane area being modified by the presence of a multiplicity of spaced-apart impressions formed in said plate and arranged in groups in accordance with a predetermined pattern and at a predetermined density on said substantially flat surface, said impressions being positioned between plane areas and including peak portions which extend beyond said substantially flat surface and depressed portions which extend within said plate beneath said substantially flat surface, said impressions having a size D which is the dimension of said peak portion and which is in the range of 10 to 300 $\mu$m, said impressions having a surface occupying density which is the ratio of plate surface area occupied by said impressions to surface area unoccupied by said impressions, and which is 30–100%, said patterned groups having minimum lengths and widths in the range of 1 mm or greater.

10. An uneven patterned metal plate as set forth in claim 9, wherein said impressions are formed into essentially circular configuration having said predetermined diameter of D.

11. An uneven patterned metal plate as set forth in claim 9, wherein said impressions are formed on said metal plate through a temper rolling process by means of a dulled work roll on which an uneven pattern corresponding to the uneven pattern to be formed on said metal plate is formed.

12. An uneven patterned metal plate as set forth in claim 11, wherein the dulling operation is performed by means of high energy beam.

13. An uneven patterned metal plate as set forth in claim 9, wherein said pattern group is in the form of a line having a width greater than or equal to 1 mm and said pattern group is spaced from the next pattern group at a distance equal to or greater than 1 mm.

14. An uneven patterned metal plate as set forth in claim 9, which is formed with a plating layer on said surface.

15. An uneven patterned metal plate as set forth in claim 14, wherein said plating layer has a greater thickness at the projecting peak portion of each impression than that at the depressed portion of each impression.

16. In a process for forming a metal plate having a substantially flat surface provided with a specifically patterned plane area, the steps which comprise dulling to the surface of said plane area a multiplicity of spaced-apart impressions formed in said plate and arranged in groups in accordance with a predetermined pattern and at a predetermined density on said substantially flat surface, said dulling being applied by a temper roll having a surface roughness Ra equal to or less than 0.40 μm, said impression being positioned between plane areas and including peak portions which extend beyond said substantially flat surface and depressed portions which extend within said plane beneath said substantially flat surface, said impressions having a size D which is the dimension of said peak portion and which is in the range of 10 to 300 μm, said impressions having a surface occupation density which is the ratio of plate surface area occupied by said impressions to surface area unoccupied by said impressions, and which is 30–100%, said patterned groups having minimum lengths and widths in the range of 1 mm or greater, and transferring the spaced-apart impressions to the surface of said metal plate.

17. A process as set forth in claim 16, wherein said dulling operation for forming impressions constituting said pattern is performed by means a high density energy beam.

18. A process as set forth in claim 17, wherein said dulling operation is performed by means of a laser beam.

19. A process as set forth in claim 16, wherein the surface roughness Ra of said plane area is smaller than or equal to 0.40 μm.

20. A process as set forth in claim 16, wherein said impressions are formed into an essentially circular configuration having a predetermined diameter of D.

21. A process as set forth in claim 16, wherein said pattern group has a width greater than or equal to 1 mm.

22. A process as set forth in claim 16, wherein said pattern group has an axial length greater than or equal to 1 mm.

23. A process as set forth in claim 16, wherein said impressions are formed on said metal plate through a temper rolling process by means of a dulled work roll on which an uneven pattern corresponding to the uneven pattern to be formed on said metal plate is formed.

24. A process as set forth in claim 23, wherein said dulling operation is performed by means of a high energy beam.

25. A process as set forth in claim 16, wherein said pattern group is in the form of a line having a width greater than or equal to 1 mm and wherein said pattern group in the form of line is spaced apart from the next pattern group at a distance greater than or equal to 1 mm.

26. A process as set forth in claim 16, which is formed with a plating layer on said surface.

27. A process as set forth in claim 26, wherein said plating layer has less thickness at the projecting peak portion of each impression than at the depressed portion of each impression.

28. A process as set forth in claim 26, wherein said temper rolling operation is performed with by driving one of said temper rolls and a roll with a plane surface and contacting with said temper roll to cause a relative shift in the axial direction.

29. A process as set forth in claim 28, wherein the shifting magnitude of relative shift between said work roll and said plane surface roll is greater than or equal to half of the interval between the lines.

30. A process as set forth in claim 29, wherein said relative shift in axial direction of said work roll and said plane surface roll is performed continuously.

31. A process as set forth in claim 30, wherein said relative shifting speed is substantially lower than the line speed of the metal strip in the temper rolling process.

32. A process as set forth in claim 16, wherein said temper rolling operation is performed by driving one of said temper rolls and a roll with a plane surface and contacting with said temper roll to cause a relative shift in the axial direction.

33. A process as set forth in claim 32, wherein said relative shift in axial direction of said work roll and said plane surface roll is performed continuously.

34. A process as set forth in claim 33, wherein the relative shifting speed is substantially lower than the line speed of the metal strip in the temper rolling process.

* * * * *

UNITED STATES PATENT AND TRADEMARK OFFICE

CERTIFICATE OF CORRECTION

PATENT NO. : 4,978,583

DATED : December 18, 1990

INVENTOR(S) : Tsuneyoshi Wakui et al

It is certified that error appears in the above-identified patent and that said Letters Patent is hereby corrected as shown below:

Column 1, line 21, after "paint" insert --a--.

Column 3, line 2, delete ":" and insert therefor --.--.

Column 6, line 18, delete "with".

Column 6, line 52, delete "subject" and insert therefor --subjected--.

Column 6, line 55, after "irradiating" insert --with a--.

Column 10, bridging lines 58 and 59, after "container" insert --and--.

Column 14, line 25, after "with" insert --a--.

Column 14, line 26, delete "patter" and insert therefor --pattern--.

Column 19, line 16, delete "$30 \leq 100(\%)$" and insert therefor --$30 \leq \eta \leq 100(\%)$--.

UNITED STATES PATENT AND TRADEMARK OFFICE

CERTIFICATE OF CORRECTION

PATENT NO. : 4,978,583

DATED : December 18, 1990

INVENTOR(S) : Tsuneyoshi Wakui et al

It is certified that error appears in the above-identified patent and that said Letters Patent is hereby corrected as shown below:

Column 19, line 16, delete "30$\eta \leqq$ 100(%)" and insert therefor --30 $\leqq \eta \leqq$ 100(%) --.

Signed and Sealed this

Ninth Day of June, 1992

*Attest:*

DOUGLAS B. COMER

*Attesting Officer*

*Acting Commissioner of Patents and Trademarks*